US006632188B2

(12) United States Patent
Thomas et al.

(10) Patent No.: US 6,632,188 B2
(45) Date of Patent: Oct. 14, 2003

(54) FOOT MASSAGING APPARATUS UTILIZING AIR INFLATED NODES AND AIR INFLATED NODES COMBINED WITH A FLUID

(75) Inventors: Paul B. Thomas, San Pedro, CA (US); Robert D. Leventhal, Los Angeles, CA (US)

(73) Assignee: D2RM Corp., Gardena, CA (US)

( * ) Notice: Subject to any disclaimer, the term of this patent is extended or adjusted under 35 U.S.C. 154(b) by 0 days.

(21) Appl. No.: 09/755,788

(22) Filed: Jan. 8, 2001

(65) Prior Publication Data

US 2002/0091344 A1 Jul. 11, 2002

(51) Int. Cl.[7] ..... A61H 9/00; A61H 23/00
(52) U.S. Cl. ..... 601/152; 601/69
(58) Field of Search ..... 601/70, 69, 148–152

(56) References Cited

U.S. PATENT DOCUMENTS

| | | | | |
|---|---|---|---|---|
| 2,531,074 A | | 11/1950 | Miller | |
| 3,888,242 A | | 6/1975 | Harris et al. | |
| 4,149,529 A | | 4/1979 | Copeland et al. | |
| 4,884,574 A | * | 12/1989 | Hardie et al. | 601/149 |
| 4,947,834 A | * | 8/1990 | Kartheus et al. | 128/64 |
| 4,989,589 A | | 2/1991 | Pekanmaki et al. | |
| 5,074,285 A | | 12/1991 | Wright | |
| 5,233,974 A | | 8/1993 | Senoue et al. | |
| 5,241,953 A | * | 9/1993 | Sykes | 601/166 |
| 5,435,009 A | | 7/1995 | Schild et al. | |
| 5,806,208 A | | 9/1998 | French | |
| 5,836,899 A | | 11/1998 | Reilly | |
| 5,868,690 A | | 2/1999 | Eischen, Sr. | |
| 5,891,065 A | | 4/1999 | Cariapa et al. | |
| 2003/0004442 A1 | * | 1/2003 | Hafemann | 601/19 |

FOREIGN PATENT DOCUMENTS

| | | |
|---|---|---|
| WO | WO85/03219 | 6/1985 |

* cited by examiner

*Primary Examiner*—Nicholas D. Lucchesi
*Assistant Examiner*—Victor Hwang
(74) *Attorney, Agent, or Firm*—Thomas I. Rozsa; Tony D. Chen

(57) ABSTRACT

An air foot massaging apparatus for massaging and stimulating tired feet, and thereby creating beneficial physiological effects throughout the body and including a pair of boot shaped structures for adapting to the user's feet or a unitary fluid-tight container for retaining fluid therein and adapting to a user's feet. Each boot shaped structure has a plurality of interior compressible and expandable air nodes which engage with the user's foot, a compressor to inflate or deflate the compressible and expandable air nodes for providing an effective massaging pattern to massage the user's feet, a vibration motor for providing a vibrational massage to further provide an effective massaging pattern to massage the user's feet, and a control mechanism for controlling the inflating and deflating of the plurality of compressible and expandable air nodes.

20 Claims, 17 Drawing Sheets

FOOT MASSAGING APPARATUS UTILIZING AIR INFLATED NODES AND AIR INFLATED NODES COMBINED WITH A FLUID

BACKGROUND OF THE INVENTION

1. Field of the Invention

The present invention relates generally to the field of massaging devices. More particularly, the present invention relates to the field of fluid and non-fluid foot massaging devices for relieving and soothing the tired feet of a person, thereby creating beneficial physiological effects throughout the body.

2. Description of the Prior Art

The use of vibrational foot massaging devices is known in the prior art. Specifically, foot massaging devices heretofore devised and utilized for the purpose of massaging a person's feet are known, but they have not been satisfactory. These prior art foot massaging devices do not provide an effective massaging pattern to make them beneficial to fully provide a soothing and relaxing effect.

Therefore, it can be appreciated that there exists a continuing need for new and improved foot massaging apparatus which can be used for massaging a person's feet.

It is desirable to provide an air foot massaging apparatus which provides an air matrix arrangement surface that is both supportive and pliable with minimal surface tension. It is also desirable to provide an air foot massaging apparatus that not only supports the user's feet but also provides an effective massaging pattern on the user's feet when the feet are positioned within the air foot massaging apparatus. It is further desirable to provide an air foot massaging apparatus which can be utilized with fluid or without fluid.

SUMMARY OF THE INVENTION

The present invention is a novel and unique air foot massaging apparatus for massaging and stimulating tired feet, and which thereby creates beneficial physiological effects throughout the body.

It is an object of the present invention to provide an air foot massaging apparatus which includes a pair of boot shaped structures, each having a plurality of spaced apart interior compressible and expandable air nodes or glands which engage with a user's feet for providing an effective massaging pattern to massage the user's feet which effectively soothes and relaxes the user.

It is also an object of the present invention to provide an air foot massaging apparatus that is fluid-tight for retaining fluid therein to provide lubrication to the user's feet, where a plurality of interior compressible and expandable air nodes or glands along with the fluid provide an effective massaging pattern to massage the user's feet which effectively soothes and relaxes the user.

It is an additional object of the present invention to provide an air foot massaging apparatus which includes an eccentric vibration means for generating vibrations to and through a plate which in turn creates resonance vibrations to massage the user's feet.

It is a further object of the present invention to provide an air foot massaging apparatus which massages and stimulates the tired feet of a user.

It is still a further object of the present invention to provide an air foot massaging apparatus which may be employed with the user in the sitting position.

It is still a further object of the present invention to provide an air foot massaging apparatus that is simple, durable, economical and lightweight.

In the preferred embodiment of the present invention, the air foot massaging apparatus includes a pair of boot shaped structures for adapting to the user's feet. Each boot shaped structure has a plurality of interior compressible and expandable air nodes or glands which engage with the user's foot, means to inflate and deflate the compressible and expandable air nodes for providing an effective massaging pattern to massage the user's feet, vibration means for providing a vibrational massage to further provide an effective massaging pattern to massage the user's feet, and control means for controlling the inflating and deflating of the plurality of compressible and expandable air nodes.

In an alternative embodiment of the present invention, the air foot massaging apparatus includes a unitary fluid-tight foot structure for retaining a fluid such as water therein and adapting to a user's feet. The structure has a plurality of interior compressible and expandable air nodes or glands which engage with the user's feet, means to inflate and deflate the compressible and expandable air nodes for providing an effective massaging pattern to massage the user's feet, vibration means for providing a vibrational massage to further provide an effective massaging pattern to massage the user's feet, and control means for controlling the inflating and deflating of the plurality of compressible and expandable air nodes.

Another alterative embodiment of the present invention air foot massaging apparatus includes a pair of boot shaped structures for containing a fluid such as water therein and adapting to the user's feet. Each boot shaped structure has a plurality of interior compressible and expandable air nodes or glands which engage with the user's foot, means to inflate and deflate the compressible and expandable air nodes for providing an effective massaging pattern to massage the user's feet, vibration means for providing a vibrational massage to further provide an effective massaging pattern to massage the user's feet, and control means for controlling the inflating and deflating of the plurality of compressible and expandable air nodes.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

For clarity purposes in these figures, pneumatic tubing and electric wiring are not illustrated, but are conventional in the art and would be easily accomplished by persons skilled in the art.

Figure 1:
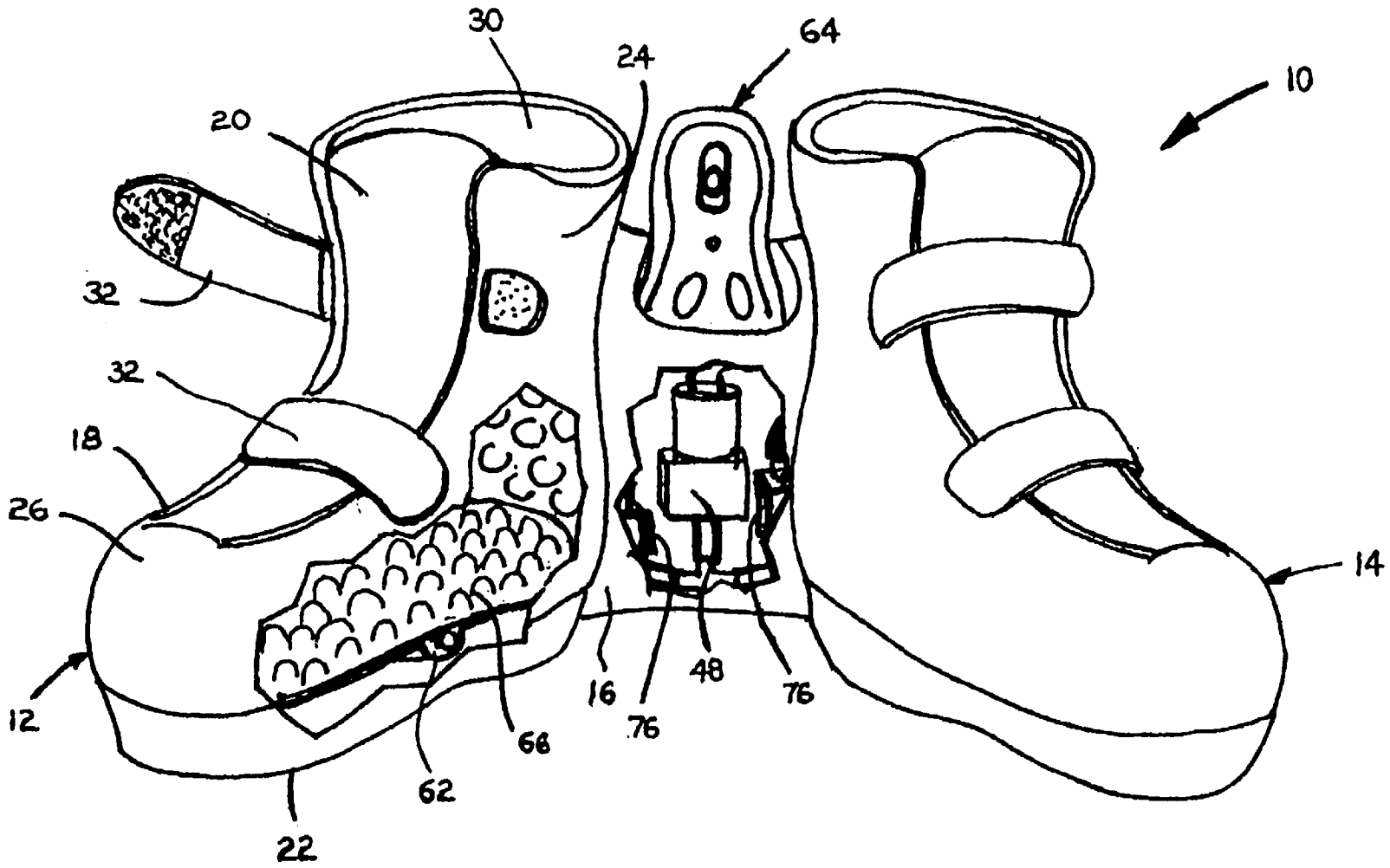
FIG. 1 is a perspective view of the preferred embodiment of the present invention air foot massaging apparatus with portions thereof broken away to better illustrate the interior structure of the components forming a part of the present invention.
Figure 2:
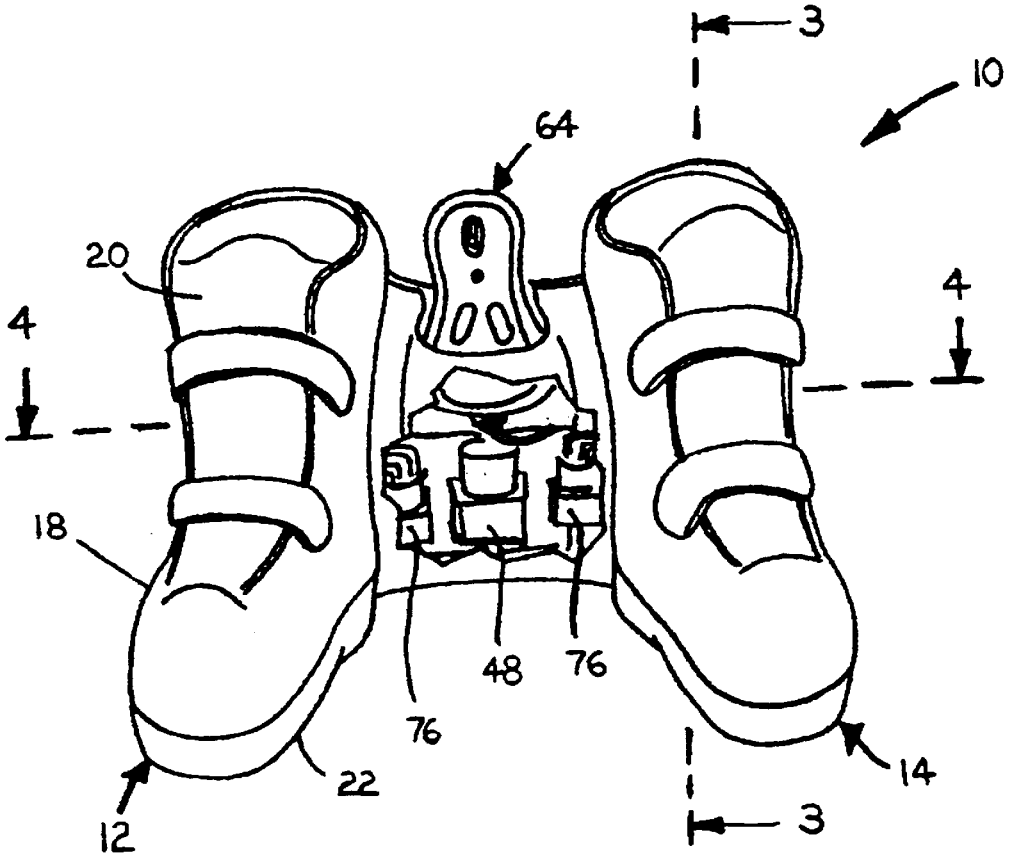
FIG. 2 is a perspective view of the air foot massaging apparatus shown in FIG. 1.

Referring to FIGS. 1 and 2, there is shown at 10 a preferred embodiment of the present invention air foot massaging apparatus for adapting to and massaging a user's feet. The air foot massaging apparatus 10 includes a pair of right and left boot shaped structures 12 and 14 connected together by a flexible connecting member 16 which is attached to the rear ends of the pair of boot shaped structures 12 and 14, so that the air foot massaging apparatus 10 can be used as a stationary device to prevent injury.

Because the pair of boot shaped structures 12 and 14 are preferably a mirror image of each other in construction, only the right boot shaped structure 12 will be described in detail below. The boot shaped structure 12 includes a shoe body 18 and a sole portion 22 that is generally shaped like the bottom of a human foot which extends from the toes to the heel of the foot and a periphery formed therearound. The shoe body 18 is integrally connected to the periphery of the sole portion 22 and extends upwardly to form the boot shaped structure 12. A front sleeve portion 20 is pivotably attached to the front end of the shoe body 18 for allowing a user's foot to be positioned within the boot shaped structure 12. The front sleeve portion 20 is secured thereto by a pair of fastener means 32. The shoe body 18, the sole portion 22 and the front sleeve portion 20 form an enclosed interior foot chamber 29 with a front lower member 26 that covers the toe area and the instep area of the user's foot and a rear upper member 24 that covers the heel area and ankle area of the user's foot.

It will be appreciated that the present invention air foot massaging apparatus 10 is not limited to the VELCRO® fastener means 32 as shown in FIG. 1. It is emphasized that while the VELCRO® fastener means are preferred, it is also within the spirit and scope of the present invention to utilize zipper means, snap means or other suitable means for connecting the front sleeve portion 20 to the shoe body 18 of the boot shaped structure 12.

Figure 6:
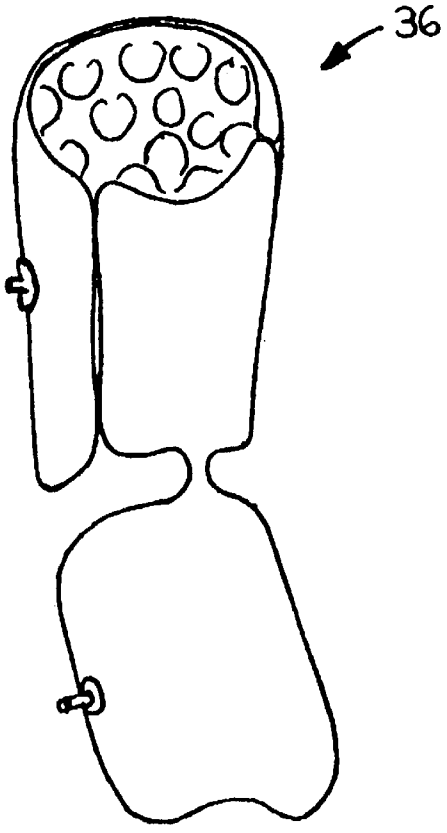
FIG. 6 is a perspective view of the left-side air massage insert of the present invention air foot massaging apparatus.
Figure 7:
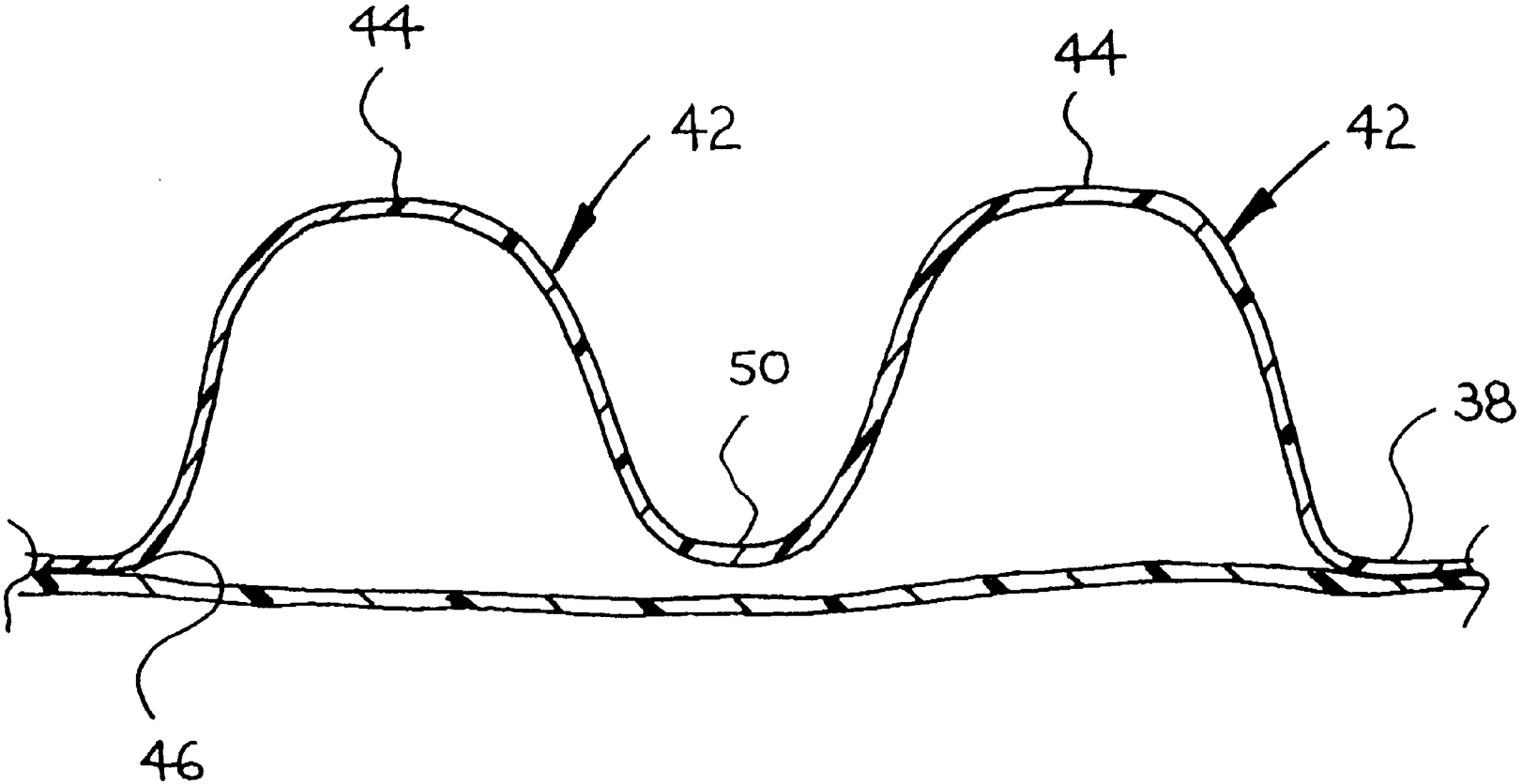
FIG. 7 is a cross-sectional view of two of the compressible and expandable air nodes of the present invention air foot massaging apparatus.

Referring to FIGS. 1, 5, 6 and 7, the air foot massaging apparatus 10 further includes right and left air massage inserts 34 and 36 that respectively match the interior of the right and left boot shaped structures 12 and 14. These air massage inserts 34 and 36 are airtight and fluid-tight to prevent air or fluid leakage. Because the air massage inserts 34 and 36 are preferably mirror-image in construction, only the right air massage insert 34 will be described in detail. The air massage insert 34 includes a vamp massage section 80 and an upper massage section 82. The air massage insert 34 may be constructed by a flexible top layer 38 and a flexible bottom layer 40 permanently affixed to the top layer 38 by ultrasonic welding, radio frequency (RF) and heat welding or other suitable means to form a plurality of spaced apart hollow adjustable air nodes or glands 42 (only two air nodes 42 are shown in FIG. 7) which are compressible and expandable. The top and bottom layers 38 and 40 form a base, where the air nodes 42 extend upwardly therefrom. The air nodes 42 are formed in a matrix arrangement and may be further customized by utilizing zoned distribution, where the air massage insert 34 may include at least two different zone sections therein, wherein each zone section can be pressurized at different intervals or times.

It will be appreciated that the construction of the air massage insert 34 is not limited to the description just discussed above. It is emphasized that while the construction method disclosed above is the preferred method, it is also within the spirit and scope of the present invention to utilize other types of the construction methods known in the art.

Referring to FIG. 7, the plurality of air nodes 42 are substantially identical, and therefore, only one will be described in detail below. Each hollow air node 42 has a generally cylindrical shaped configuration with a distal end 44 and an open proximal end 46. The proximal end 46 is integrally formed with the top layer 38 of the air massage body 36 such that the hollow air nodes 42 are compressible when a downward pressure is applied or expandable when a pneumatic compressor means 48 supplies air to the air nodes 42.

There is provided a plurality of pneumatic connecting tubes or fluid ducts 50 (only one is shown) which are substantially identical, and therefore, only one will be described in detail. Each connecting tube 50 is integrally formed with the top layer 38 of the air massage insert 34, where each connecting tube 50 is respectively interconnected to adjacent air nodes 42 for allowing pneumatic or fluid to flow in between the air nodes 42. It will be appreciated that the present invention air foot massaging apparatus 10 is not limited to the plurality of connecting tubes 50 as shown. It is emphasized that while the connecting tubes 50 are preferred, it is also within the spirit and scope of the present invention to utilize other types of pneumatic or fluid transfer means for allowing pneumatic or fluid to flow in between the plurality of air nodes 42.

Referring to FIGS. 1 through 7, the ability of the air foot massaging apparatus 10 to adjust the relative pressure over a range to suit various foot sizes creates a comfortable sensation for the user. The massaging apparatus 10 further has the capability of rapidly inflating and deflating the plurality of hollow air nodes 42 of each air massage insert at different intervals or times to create an effective massaging pattern for massaging the user's feet positioned within the air foot massaging apparatus 10.

Figure 3:
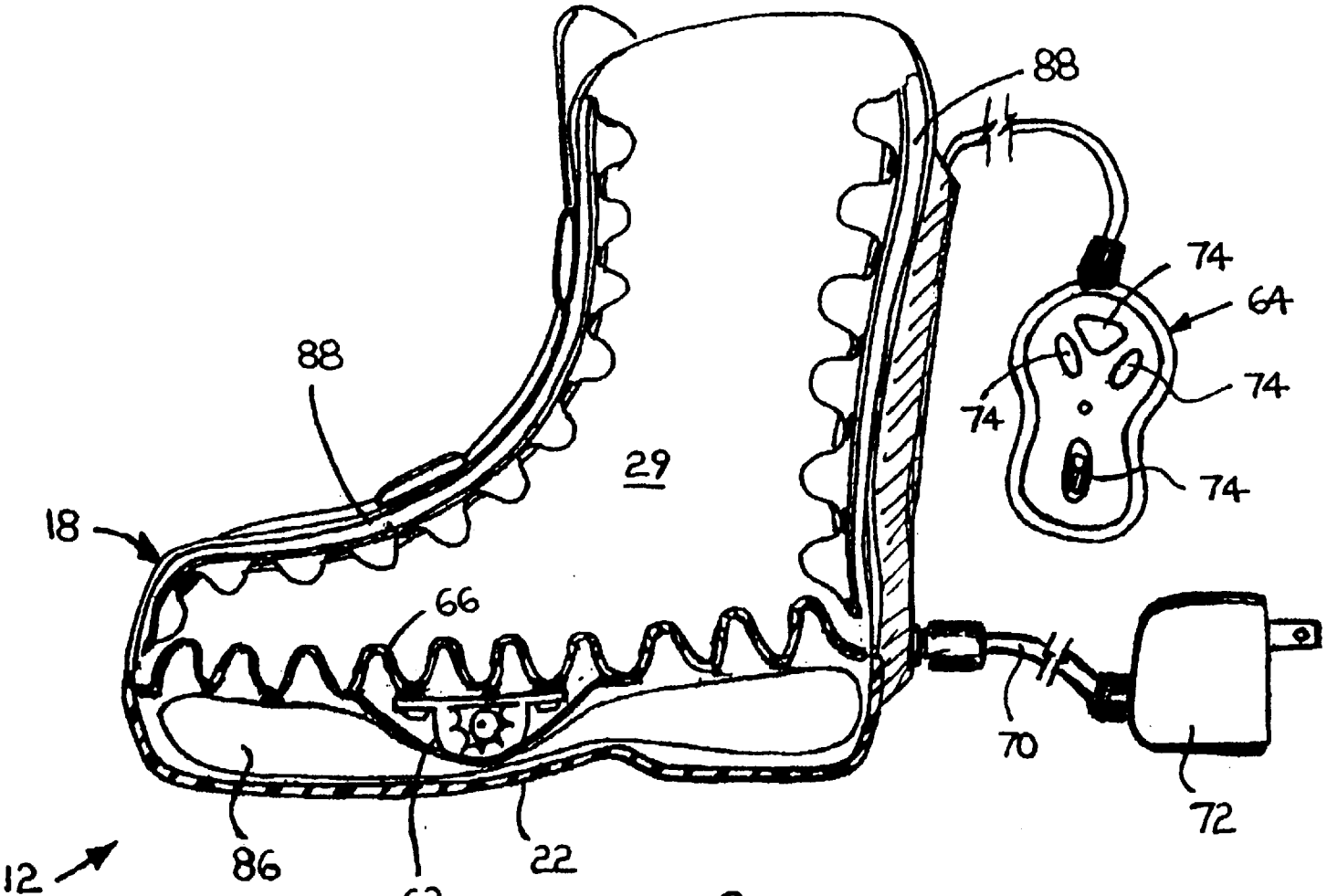
FIG. 3 is a cross-sectional view taken along line 3—3 of FIG. 2.
Figure 4:
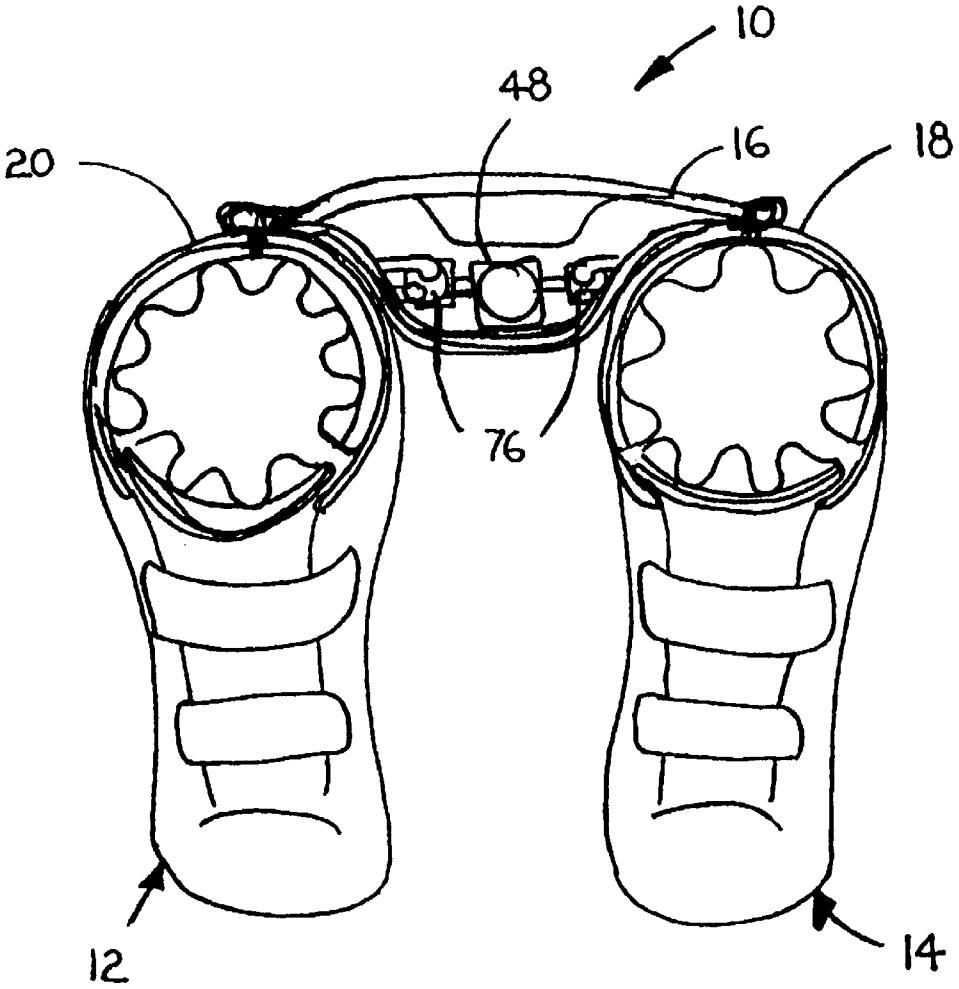
FIG. 4 is a cross-sectional view taken along line 4—4 of FIG. 2.

Referring to FIG. 3, each boot shaped structure has an eccentric vibration motor or means 62 which is conventional in the art, and therefore, it will only be described in general terms. The eccentric vibration means 62 is mounted by conventional means against the underside of a semi-flexible wave shaped support plate 66 for generating vibrations to and through the plate 66 which in turn creates resonance vibrations to massage the user's feet. The vibration means 62 may include a sonic transducer, magnetic vibratory means or other vibratory means. The support plate 66 is mounted within the interior foot chamber 29 and above the sole portion 22 and located adjacent to and parallel to the sole portion 22 of the boot shaped structure 12. There is provided an adjustable air bladder 86 which is positioned between the semi-flexible wave shaped support plate 66 and the sole portion 22 for adjusting the height of the support plate 66 to accommodate different sizes of feet within the boot shaped structure 12. This adjustable air bladder 86 is connected to the compressor means 48 by conventional means.

Figure 5:
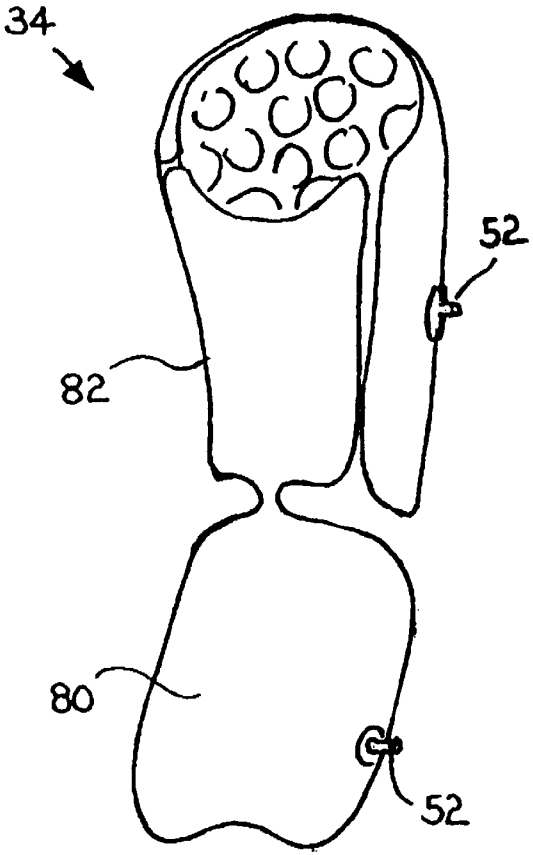
FIG. 5 is a perspective view of the right-side air massage insert of the present invention air foot massaging apparatus.

Referring to FIG. 5, the air massage insert 34 has at least two ports 52 which allow pneumatic fluid to enter or evacuate from the insert 34. The ports 52 are connected to the compressor means 48 via elongated pneumatic supply tubes which are conventional in the art. In this case, a manifold (not shown) may be utilized and is connected between the ports 52 of the air massage inserts 34 and 36. The ports 52 may be connected to a conventional solenoid valve 76, which operates in a known manner to control the flow of pneumatic fluid into or out of the plurality of air nodes 42 of each air massage insert. In the preparation of the air massage inserts 34 and 36 for use, the valve is open, so that any pneumatic fluid under pressure is supplied through the ports 52 to the pneumatic supply tubes which in turn supply the fluid such as compressed air to the air massage inserts 34 and 36. The connecting tubes 50 are then supplying the compressed air under pressure to all of the air nodes 42 within each air massage insert, where the hollow air nodes 42 of each air massage insert are inflated to a desired stiffness. When the air massage inserts 34 and 36 have been filled with the desired amount of compressed air, the ports 52 are closed off by a suitable cap (not shown).

Referring to FIG. 3, an elongated electric cord 70 is provided with the present invention air foot massaging apparatus 10 and has a plug 72 at its end for connection to an appropriate wall outlet (not shown). The electric cord 70 supplies electric current to the vibration means 62 and the compressor means 48, where the controller means 64 is electrically connected to the vibration means 62 and the compressor means 48 and controls all operation of the air foot massaging apparatus 10 by the switches 74. The controller means 64 cycles the inflation and deflation rates at different intervals of the plurality of compressible and expandable air nodes 42 of each boot shaped structure to create a massaging pattern to massage the user's feet within the air foot massaging apparatus 10.

One of the unique features of the present invention air foot massaging apparatus 10 is that the vibration means has the capability of breaking the contact between the user's feet and the plurality of compressible and expandable air nodes 42.

There are provided a plurality of adjustable air bladders 88 which are similar to the adjustable air bladder 86. These adjustable air bladders 88 are positioned between the interior surface of the shoe bodies 18 and the inserts 34 and 36 for adjusting the inserts 34 and 36 inwardly or outwardly to accommodate different sizes of feet within the boot shaped structures 12 and 14. The adjustable air bladders 88 are connected to the compressor means 48 by conventional means.

Figure 8:
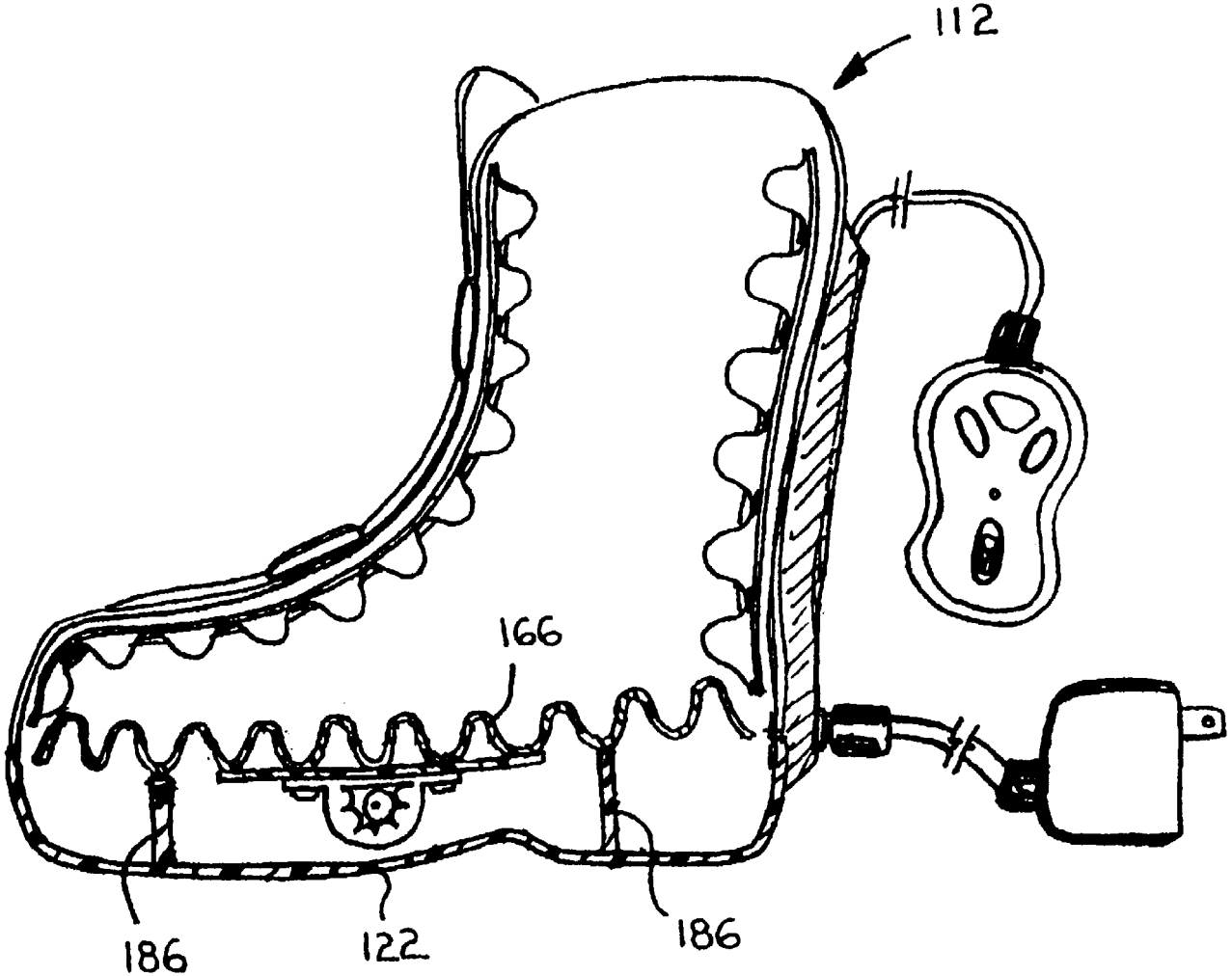
FIG. 8 is a cross-sectional view of an alternative arrangement of the present invention air foot massaging apparatus that is similar to FIG. 3 except that there is shown a plurality of supporting dividers.

Referring to FIG. 8, there is shown an alternative embodiment of the present invention air foot massaging apparatus which is very similar to the preferred embodiment just discussed. All of the parts of this alternative embodiment of the air foot massaging apparatus 110 are numbered correspondingly with 100 added to each number. Since it assembles and functions the same as previously described above except that the adjustable air bladder 86 (shown in FIG. 3) is substituted with a plurality of spaced apart vertical supporting dividers 186 for supporting the semi-flexible support plate 166, the description thereof will not be repeated.

Figure 9:
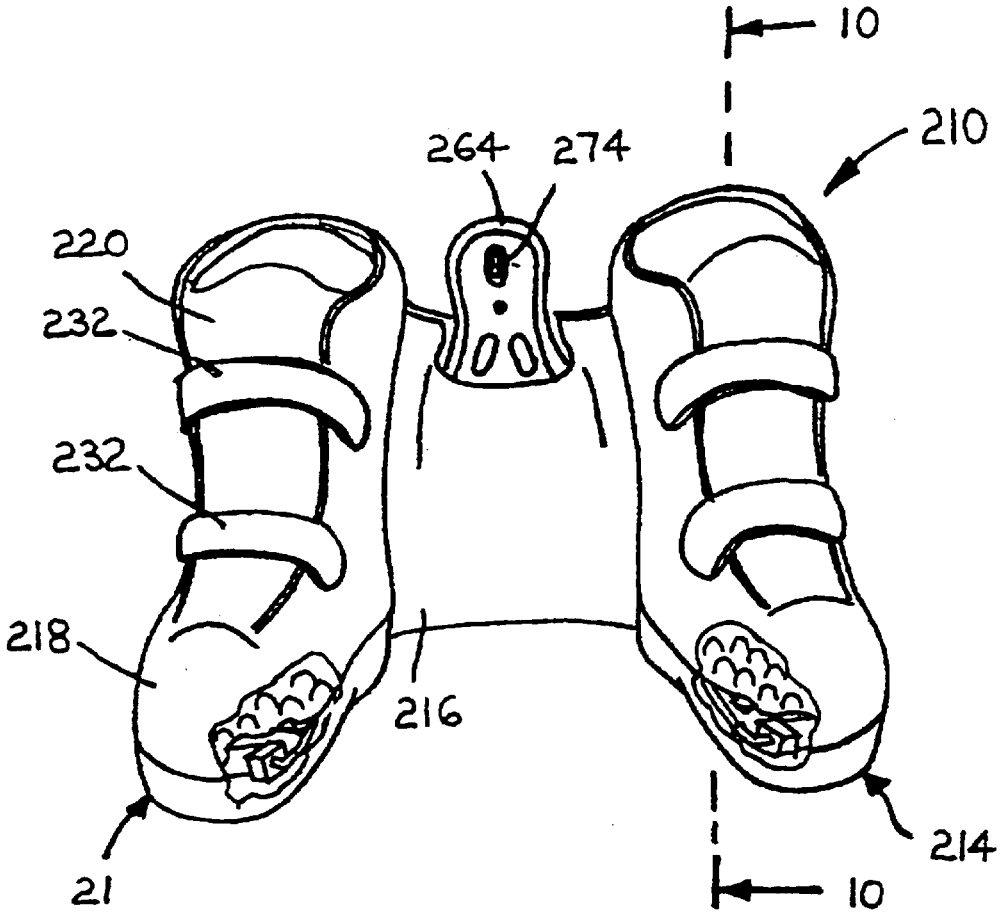
FIG. 9 is a perspective view of another alternative arrangement of the present invention air foot massaging apparatus with portions thereof broken away to better illustrate the interior structure of the components forming a part of the present invention.
Figure 10:
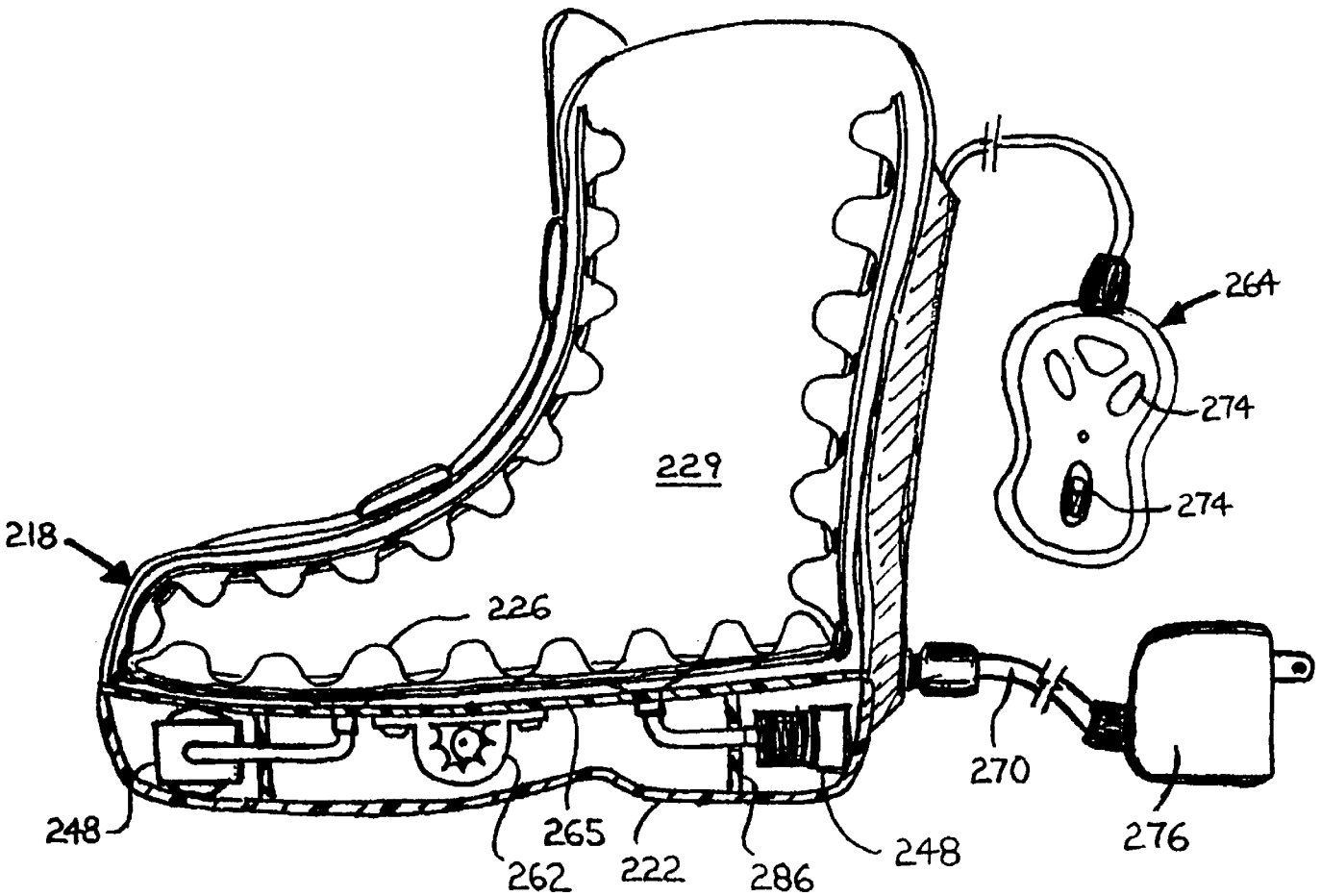
FIG. 10 is a cross-sectional view taken along line 10—10 of the FIG. 9.

Referring to FIGS. 9 and 10, there is shown another alternative embodiment of the present invention air foot massaging apparatus 210 which is very similar to the preferred embodiment discussed above and the only differences are the nature and configuration of the air compressor means 248 and the plurality of spaced apart vertical supporting dividers 286. All of the parts of this embodiment of the present invention air foot massaging apparatus 210 are numbered correspondingly with 200 added to each number.

The air foot massaging apparatus 210 includes a pair of right and left boot shaped structures 212 and 214 connected together by a flexible connecting member 216 which is attached to the rear ends of the pair of boot shaped structures 212 and 214, so that the air foot massaging apparatus 210 can be used as a stationary device to prevent injury.

Because the pair of boot shaped structures 212 and 214 are preferably mirror image of each other in construction, only the right boot shaped structure 212 will be described in detail below. The boot shaped structure 212 includes a shoe body 218 and a sole portion 222 that is generally shaped like the bottom of a human foot which extends from the toes to the heel of the foot and a periphery formed therearound. The shoe body 218 is integrally connected to the periphery of the sole portion 222 and extends upwardly to form the boot shaped structure 212. A front sleeve portion 220 is pivotably attached to the front end of the shoe body 218 for allowing a user's foot to be positioned within the boot shaped structure 212. The front sleeve portion 220 is secured thereto by a pair of fastener means 232. The shoe body 218, the sole portion 222 and the front sleeve portion 220 form an enclosed interior foot chamber 229 with a front lower member that covers the toe area and the instep area of the user's foot and a rear upper member that covers the heel area and ankle area of the user's foot.

The air foot massaging apparatus 210 further includes right and left air massage inserts which are exactly the same as shown in FIGS. 5 and 6, and therefore, the description thereof will not be repeated. The inserts respectively match the interior of the right and left boot shaped structures 212 and 214. These air massage inserts are airtight and fluid-tight to prevent air or fluid leakage.

Each boot shaped structure has an eccentric vibration motor or means 262 which is conventional in the art, and the description thereof will only be described in general terms. The eccentric vibration means 262 is mounted by conventional means against the underside of a plate 265 which is supported by a plurality of spaced apart vertical ribs 286 and located parallel to the sole portion 222. A semi-flexible solid or hollow wave shaped support plate 266 is positioned against the plate 265. The vibration means 262 generates vibrations to and through the plate 265 which in turn creates resonance vibrations to the wave-shaped support plate 266 to massage the user's feet. The vibration means 262 may include a sonic transducer, magnetic vibratory means or other vibratory means.

The ports of each of the air massage inserts are connected to each of the compressor means 248 via elongated pneumatic supply tubes which are conventional in the art. In this case, a manifold (not shown) may be utilized and is connected between the ports of the air massage inserts. The ports of each of the air massage inserts may be connected to a conventional solenoid valve, which operates in a known manner to control the flow of pneumatic fluid into or out of the plurality of air nodes of each air massage insert.

An elongated electric cord 270 is provided with the present invention air foot massaging apparatus 210 and has a plug 272 at its end for connection to an appropriate wall outlet (not shown). The electric cord 270 supplies electric current to the vibration means 262 and the compressor means 248, where the controller means 264 is electrically connected to the vibration means 262 and the compressor means 248 and controls all operation of the air foot massaging apparatus 210 by the switches 274. The controller means 264 cycles the inflation and deflation rates at different intervals of the plurality of compressible and expandable air nodes of each boot shaped structure to create a massaging pattern to massage the user's feet within the air foot massaging apparatus 210.

There are provided a plurality of adjustable air bladders 288 which are similar to the adjustable air bladder 86 (shown in FIG. 3). These adjustable air bladders 288 are positioned between the interior surface of the shoe bodies 218 and the inserts for adjusting the inserts inwardly or outwardly to accommodate different sizes of feet within the boot shaped structures 212 and 214. The adjustable air bladders 288 are connected to the compressor means 248 by conventional means.

Figure 11:
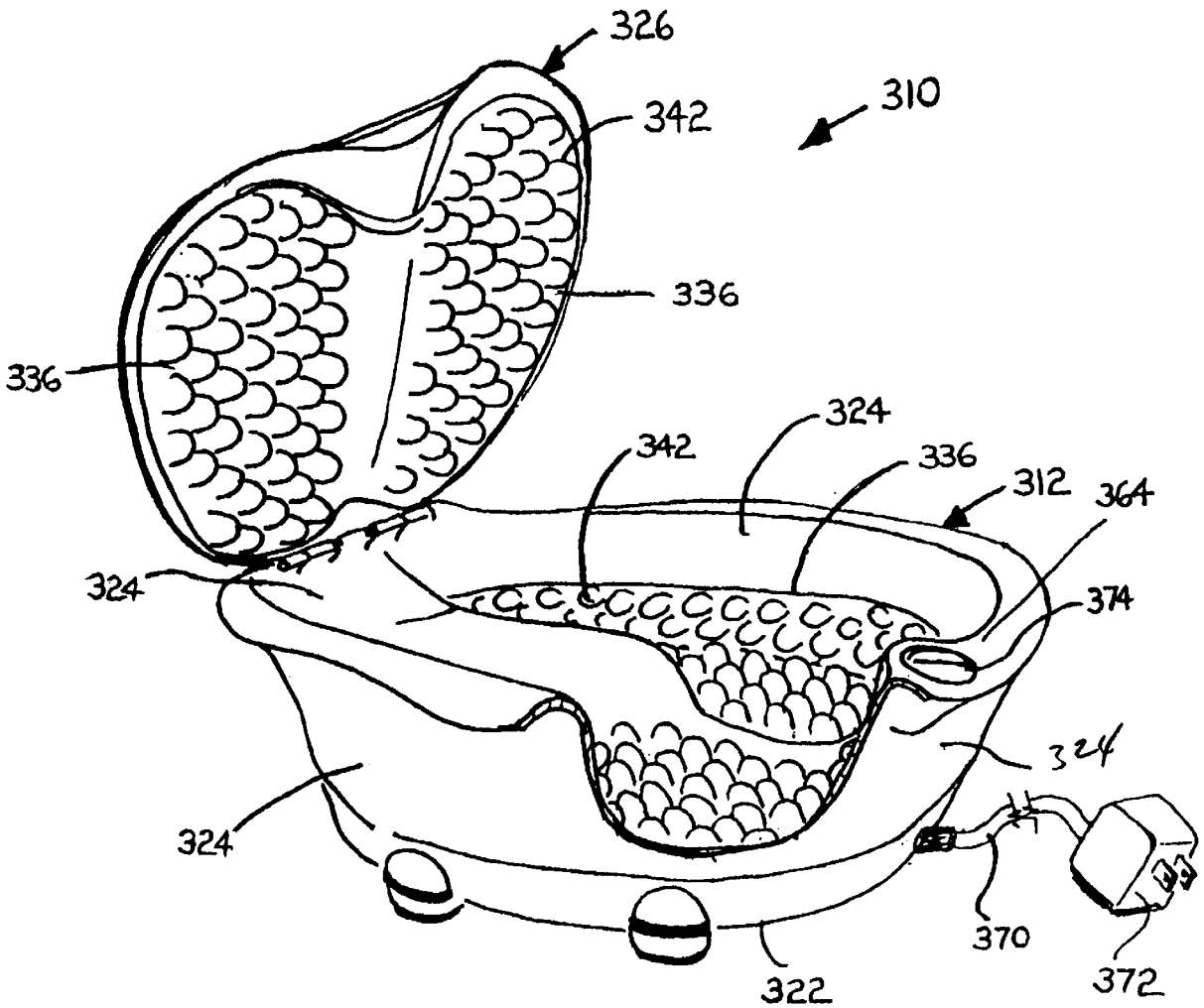
FIG. 11 is a perspective view of an alternative embodiment of the present invention air foot massaging apparatus with a portion thereof broken away to better illustrate the interior structure of the present invention.
Figure 12:
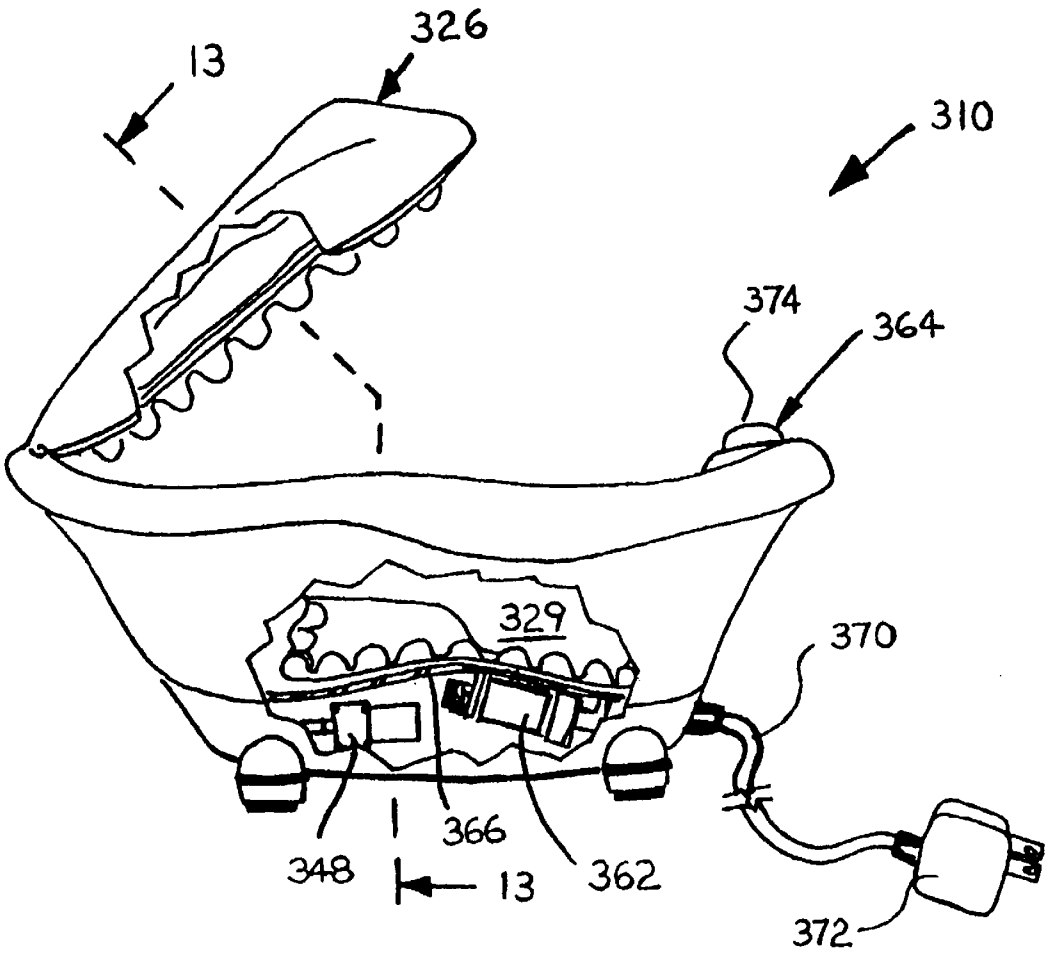
FIG. 12 is a side elevational view of the present invention air foot massaging apparatus shown in FIG. 11 with portions thereof broken away.
Figure 13:
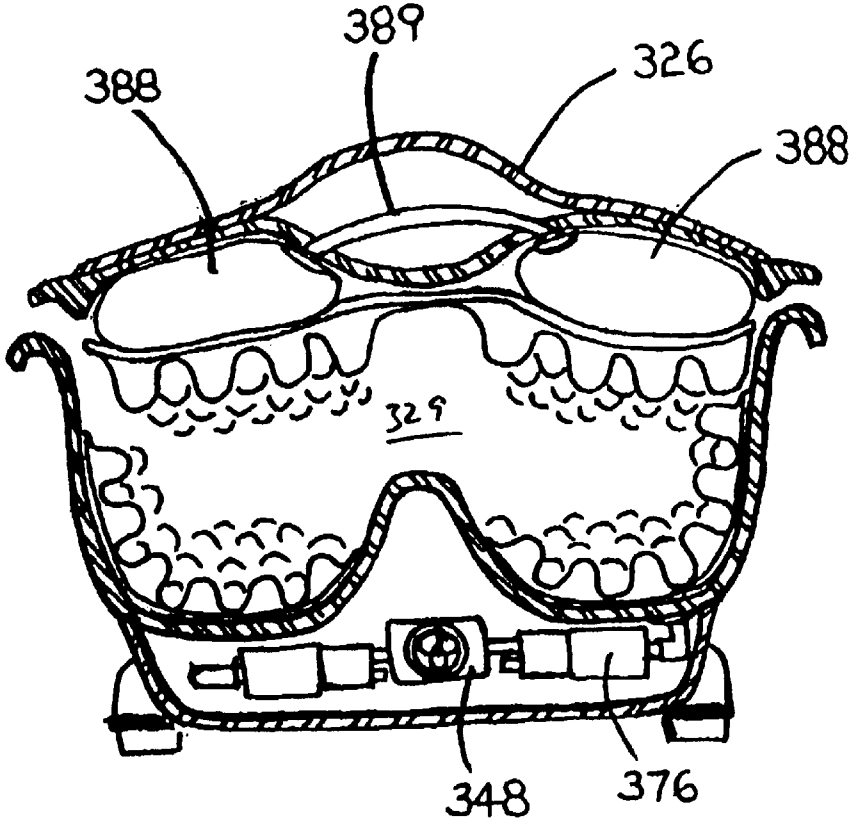
FIG. 13 is a cross-sectional view taken along line 13—13 of FIG. 12.

Referring to FIGS. 11 through 13, there is shown at 310 an alternative embodiment of the present invention air foot massaging apparatus adapted to support the user's feet and retain fluid therein. The fluid-tight housing 312 includes a base wall 322 and four walls 324 integrally connected with the base wall 322 and which extend upwardly therefrom to form a foot chamber 329 adapted to support the user's feet and retain fluid such as water therein. A lid 326 is hingably connected to an upper edge of a respective one of the four walls 324 for covering the foot chamber 329. The lid 326 can be opened to allow the user's feet to be positioned within the housing 312 or closed such that the lid 326 is parallel to the base wall 222.

The air foot massaging apparatus 310 includes a plurality of air massage inserts 336 that are airtight and fluid-tight to prevent leakage. Each air massage insert 336 includes a plurality of spaced apart hollow vertical adjustable air nodes or glands 342 (see FIG. 7) which are compressible and expandable, and a plurality of pneumatic fluid connecting tubes or fluid ducts (not shown but exactly the same as shown in FIG. 7). Because the plurality of air massage inserts 336 are preferably identical in construction (see FIGS. 5 and 6), and the process was disclosed in the preceding embodiment shown in FIGS. 1 through 7, the description thereof will not be repeated.

There is provided an eccentric vibration motor or means 362 which is conventional in the art, and the description thereof will only be described in general terms. The eccentric vibration means 362 is mounted by conventional means against the underside of a semi-rigid transmission plate 366 for generating vibrations to and through the transmission plate 366 which in turn creates resonance vibrations to the plurality of air nodes 342 to massage the user's feet. The vibration means 362 may include a sonic transducer, magnetic vibratory means or other vibratory means. The semi-rigid transmission plate 366 is mounted within the interior foot chamber 329 and above the base wall 322 and located adjacent to and parallel to the base wall 322.

Each air massage insert 336 has a port which allows pneumatic fluid to enter or evacuate from the insert and connected to the compressor means 348 by a pneumatic supply line for supplying compressed air. The compressor means 348 may be connected to a conventional solenoid valve 376, which operates in a known manner to control the flow of pneumatic fluid into or out of the plurality of air nodes 342 of each air massage insert 336. In the preparation of the air massage bodies 336 for use, the valve is open, so that any pneumatic fluid under pressure is supplied to the air massage inserts 336. The connecting tubes are then supplying the compressed air under pressure to all of the air nodes 342 within each air massage insert 336, where the hollow air nodes 342 of each massage insert 336 are inflated to a desired stiffness. When the air massage inserts 336 have been filled with the desired amount of compressed air, the valve 376 is closed off by a suitable cap (not shown).

An elongated electric cord 370 is provided with the present invention air foot massaging apparatus 310 and has a plug 372 on its end for connection to an appropriate wall outlet (not shown). The electric cord 370 supplies electric current to the vibration means 362 and the compressor means 348, where the controller means 364 is electrically connected to the vibration means 362 and the compressor means 348 and controls all operation of the air foot massaging apparatus 310 by the switches 374. The controller means 364 cycles the inflation and deflation rates at different intervals of the plurality of compressible and expandable air nodes 342 of each air massage insert 336 to create a massaging pattern to massage the user's feet within the air foot massaging apparatus 310.

There are provided a plurality of adjustable air bladders 388 which are similar to the adjustable air bladder 86 which is shown in FIG. 3. These adjustable air bladders 388 are positioned between the interior surface of the lid 326 and the upper inserts for adjusting the inserts inwardly or outwardly to accommodate different sizes of feet within the fluid-tight housing 312. The adjustable air bladders 388 are connected together by an elongated tube 389 which in may be connected to the compressor means 348 for supplying compressed air to the adjustable air bladders 388.

Figure 14:
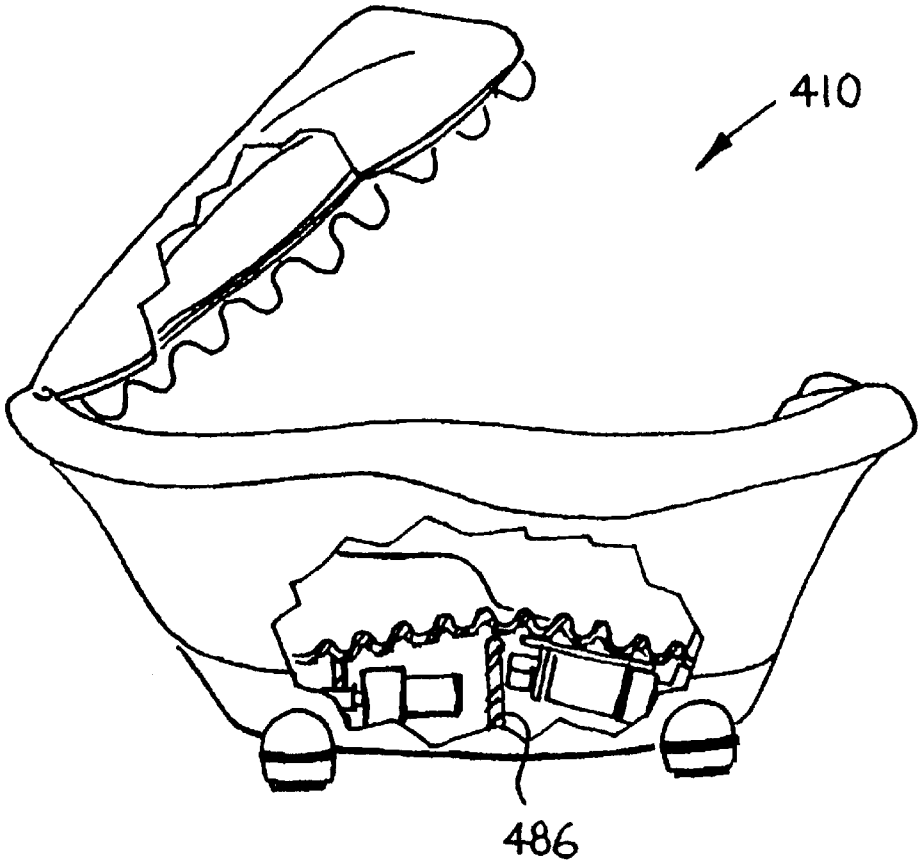
FIG. 14 is a side elevational view of the present invention air foot massaging apparatus with portions thereof broken away, showing a different arrangement of the components shown in FIGS. 11 through 13.

Referring to FIG. 14, there is shown at 410 an alternative embodiment of the present invention air foot massaging apparatus which is very similar to the embodiment just discussed above. All of the parts of this alternative embodiment of the air foot massaging apparatus 410 are numbered correspondingly with 400 added to each number. Since it assembles and functions the same as previously described above except that the floor of the fluid-tight housing 412 has a semi-flexible solid or hollow wave shaped support plate 466 supported by a plurality of spaced apart vertical supporting dividers 486 (only one is shown), the description thereof will not be repeated.

Figure 15:
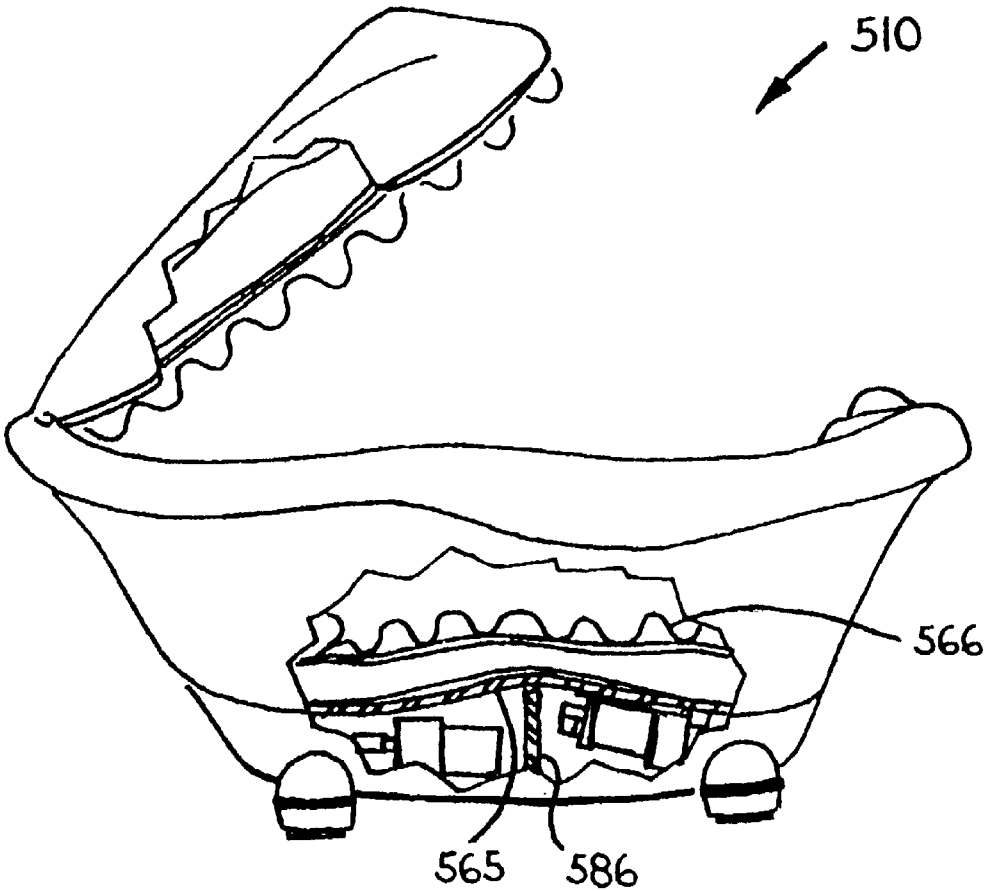
FIG. 15 is a side elevational view of the present invention air foot massaging apparatus with portions thereof broken away, showing another arrangement of the components shown in FIGS. 11 through 13.

Referring to FIG. 15, there is shown at 510 a further alternative embodiment of the present invention air foot massaging apparatus which is very similar to the embodiment discussed above. All of the parts of this alternative embodiment of the air foot massaging apparatus 510 are numbered correspondingly with 500 added to each number. Since it assembles and functions the same as previously described above except that the floor of the fluid-tight housing 412 has a semi-flexible solid or hollow wave shaped support plate 566 supported on a plate 565 by a plurality of spaced apart vertical supporting dividers 586 (only one is shown), the description thereof will not be repeated.

Figure 16:
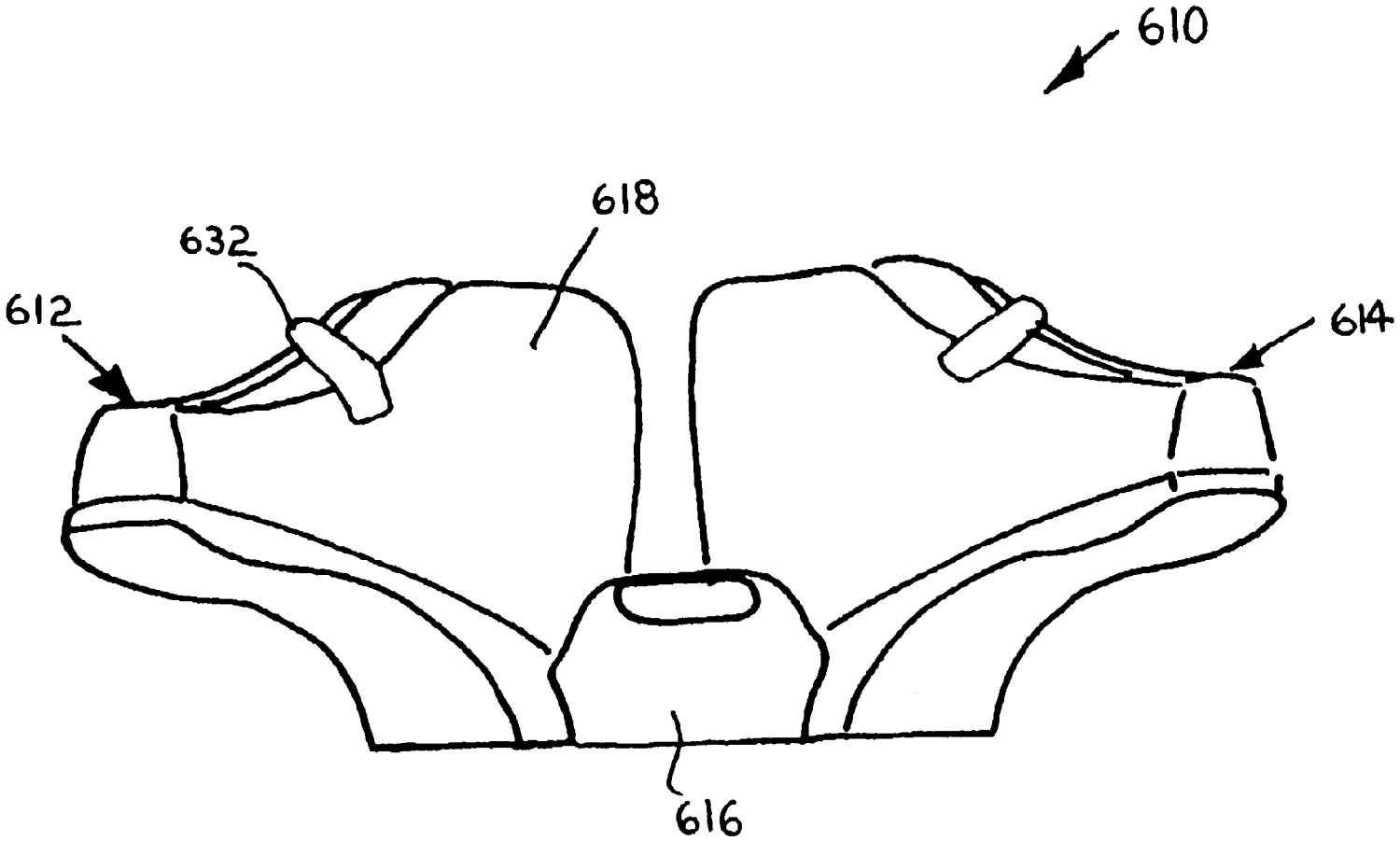
FIG. 16 is a perspective view of another alternative embodiment of the present invention air foot massaging apparatus.
Figure 17:
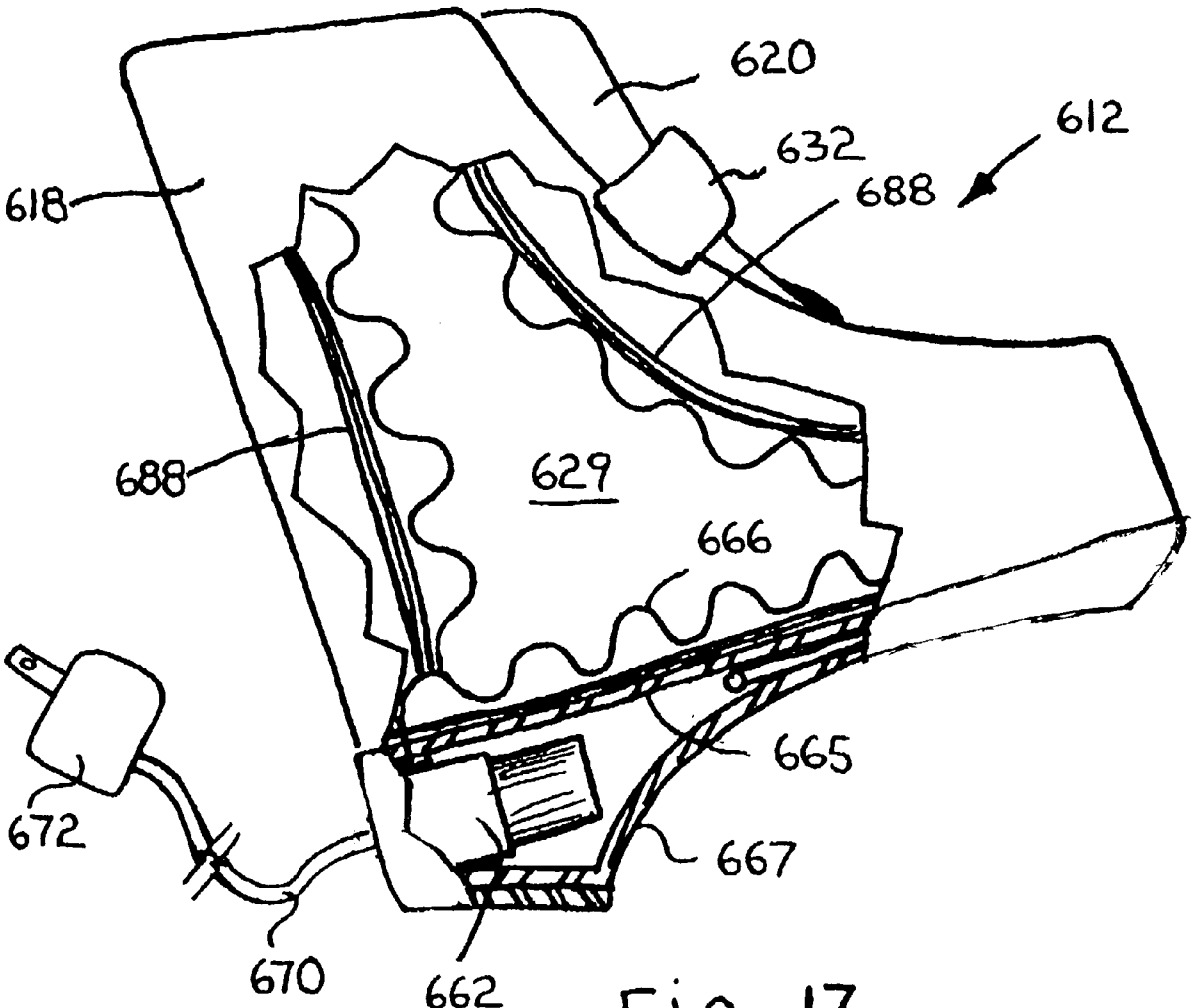
FIG. 17 is a side elevational view of the present invention air foot massaging apparatus shown in FIG. 16 with a portion thereof broken away.

Referring to FIGS. 16 and 17, there is shown a further alternative embodiment of the present invention air foot massaging apparatus 610 for adapting to and massaging a user's feet and retaining fluid therein. The air foot massaging apparatus 610 includes a pair of right and left boot shaped structures 612 and 614 connected together by a flexible connecting member 616, so that the air foot massaging apparatus 610 can be used as a stationary device to prevent injury.

Because the pair of boot shaped structures 612 and 614 are preferably mirror image of each other in construction, only the right boot shaped structure 612 will be described in detail below. The boot shaped structure 612 includes a shoe body 618 and a front sleeve portion 620 which is pivotably attached to the front end of the shoe body 618 for allowing a user's foot to be positioned within the boot shaped structure 612. The front sleeve portion 620 is secured thereto by a fastener means 632. The shoe body 818 and the front sleeve portion 20 form an enclosed interior foot chamber 629 with a front lower member that covers the toe area and the instep area of the user's foot and a rear upper member that covers the heel area and ankle area of the user's foot.

The air foot massaging apparatus 610 further includes right and left air massage inserts which are exactly the same as shown in FIGS. 5 and 6, and the description thereof will not be repeated. The inserts respectively match the interior of the right and left boot shaped structures 612 and 614. These air massage inserts are airtight and fluid-tight to prevent air or fluid leakage.

Each boot shaped structure has a bottom heel portion 667 which stores an eccentric vibration motor or means 62 which is conventional in the art, and the description thereof will only be described in general terms. The eccentric vibration means 662 is mounted by conventional means against the underside of a plate 665. A semi-flexible solid or hollow wave shaped support plate 666 is positioned on top of the plate 665. The vibration means 662 generates vibrations to and through the plate 665 which in turn creates resonance vibrations to the wave-shaped support plate 666 to massage the user's feet. The vibration means 662 may include a sonic transducer, magnetic vibratory means or other vibratory means.

The ports of each of the air massage inserts are connected to each of the compressor means via elongated pneumatic supply tubes which are conventional in the art. In this case, a manifold (not shown) may be utilized and is connected between the ports of the air massage inserts. The ports of each of the air massage inserts may be connected to a conventional solenoid valve, which operates in a known manner to control the flow of pneumatic fluid into or out of the plurality of air nodes of each air massage insert.

An elongated electric cord 670 is provided with the present invention air foot massaging apparatus 610 and has a plug 672 at its end for connection to an appropriate wall outlet (not shown). The electric cord 670 supplies electric current to the vibration means 662 and the compressor means, where the controller means is electrically connected to the vibration means 662 and the compressor means and controls all operation of the air foot massaging apparatus 610 by the switches. The controller means cycles the inflation and deflation rates at different intervals of the plurality of compressible and expandable air nodes of each boot shaped structure to create a massaging pattern to massage the user's feet within the air foot massaging apparatus 610.

There are provided a plurality of adjustable air bladders 688 which are similar to the adjustable air bladder 86 shown in FIG. 3. These adjustable air bladders 688 are positioned between the interior surface of the shoe bodies 618 and the inserts for adjusting the inserts inwardly or outwardly to accommodate different sizes of feet within the boot shaped structures 612 and 614. The adjustable air bladders 688 are connected to the compressor means by conventional means.

Figure 18:
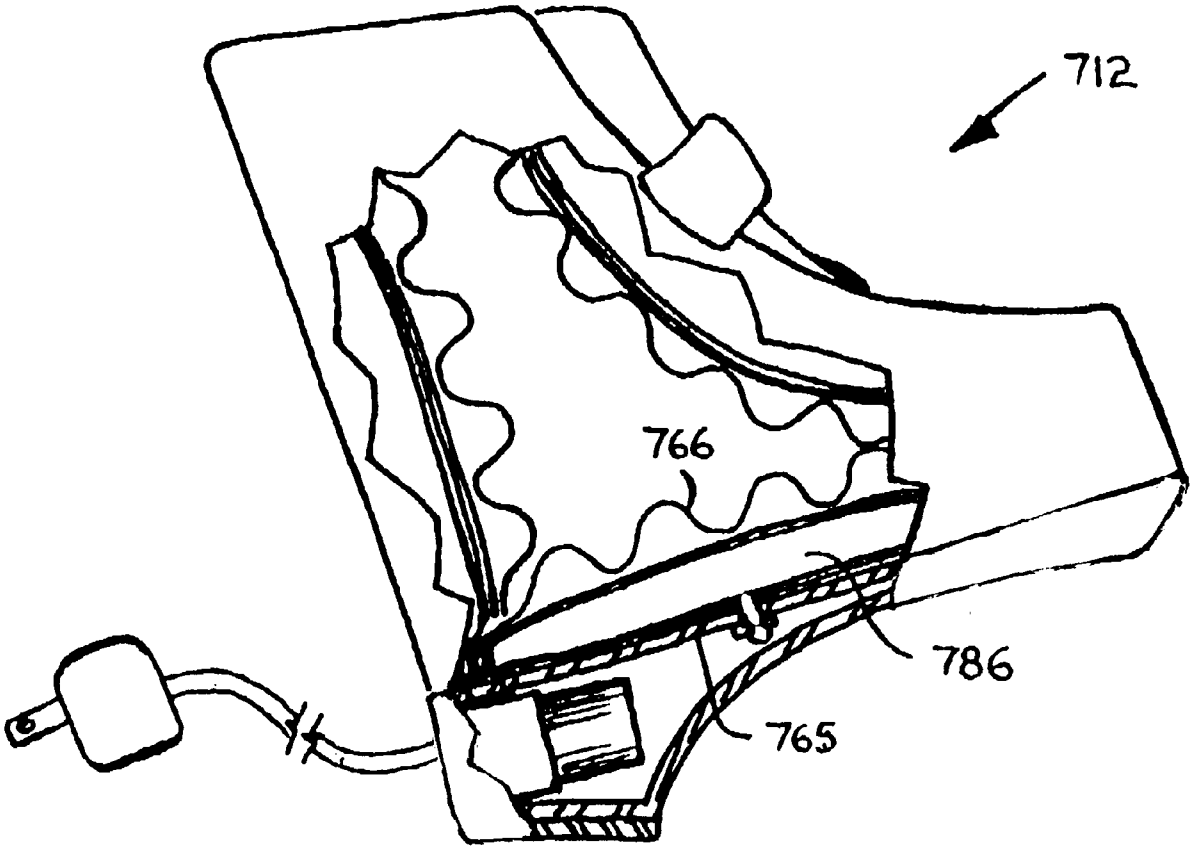
FIG. 18 is a side elevational view of the present invention air foot massaging apparatus with a portion thereof broken away, showing a different arrangement of the components shown in FIG. 17.

Referring to FIG. 18, there is shown a further arrangement of the present invention air foot massaging apparatus shown in FIGS. 16 and 17, and is very similar to the preceding embodiment just discussed. All of the parts of this embodiment of the air foot massaging apparatus are numbered correspondingly with 700 added to each number. Since it assembles and functions the same as previously described above except that there is an adjustable air bladder 786 (shown in FIG. 3) which is located between a semi-flexible solid or hollow wave shaped support plate 766 and a plate 765, the description thereof will not be repeated.

The present invention conforms to conventional forms of manufacture or any other conventional way known to one skilled in the art, and is of simple construction and is easy to use. The manufacturing process which could accommodate the construction of the air foot massaging apparatus may be injection, thermoform, etc. or other molding process. By way of example, the boot shaped structures and the fluid-tight housing can be made of plastic material. By way of example, the plurality of compressible and expandable air nodes can be made of urethane material, vinyl material or any other suitable material known in the art.

Defined in detail, the present invention is a portable air foot massaging apparatus for massaging a user's feet, comprising: (a) a pair of spaced apart boot shaped structures connected to each other by a flexible connecting member, each structure having a sole portion, a generally shaped shoe body integrally formed with the sole portion and extending upwardly therefrom, and a sleeve portion pivotably attached to a front end of the shoe body for allowing the user's foot to enter or exit the shoe body; (b) a semi-rigid support plate respectively mounted within the each boot shaped structure and spaced above and parallel to the sole portion of the each boot shaped structure and supported by a support means; (c) an insert having a plurality of spaced apart compressible and expandable air nodes affixed to the interior surface and protruding inwardly therefrom, the insert respectively positioned within the shoe body of the each boot shaped structure such that the plurality of spaced apart compressible and expandable air nodes engage with the user's foot; (d) means to interconnect the plurality of compressible and expandable air nodes for transferring fluid in between; (e) compressor means respectively mounted within the each boot shaped structure for supplying compressed air to the plurality of compressible and expandable air nodes of the insert of the each boot shaped structure; (f) valve means connected to the compressor means to control the compressed air to inflate the plurality of compressible and expandable air nodes of the insert of the each boot shaped structure to a desired stiffness; (g) a controller having means for cycling the inflation and deflation rates at different intervals of the plurality of compressible and expandable air nodes of the insert of the each boot shaped structure to create at least one massaging pattern to massage the user's feet within the pair of boot shaped structures; and (h) eccentric vibration means respectively mounted to the underside of the semi-rigid support plate of the each boot shaped structure for generating vibrations to and through the semi-rigid support plate which in turn creates resonance vibrations to massage the user's feet; (i) whereby when the user's feet are respectively positioned within the pair of boot shaped structures and the plurality of compressible and expandable air nodes are engaged with the user's feet, and thereby massage and generate the at least one massaging pattern to massage the user's feet which effectively soothes and relaxes the user.

Defined broadly, the present invention is a foot massaging apparatus for massaging a user's feet, comprising: (a) at least two boot shaped structures connected to each other by a connecting member, each structure having a sole portion, a shoe body formed with the sole portion and extending upwardly therefrom, a sleeve portion pivotably attached to the shoe body for allowing the user's foot to enter or exit the shoe body; (b) a plate respectively mounted within the each boot shaped structure and supported by a support means; (c) a plurality of compressible and expandable air nodes affixed to the interior of the shoe body of the each boot shaped structure; (d) means to interconnect the plurality of compressible and expandable air nodes for transferring fluid in between; (e) at least one compressor means for supplying compressed air to the plurality of compressible and expandable air nodes of the each boot shaped structure; (f) means for connecting the at least one compressor means to control the compressed air to inflate the plurality of compressible and expandable air nodes of the each boot shaped structure to a desired stiffness; (g) means for cycling the inflation and deflation rates at different intervals of the plurality of compressible and expandable air nodes of the each boot shaped structure to create at least one massaging pattern to massage the user's feet within the at least two boot shaped structures; and (h) means for generating vibrations to and through the plate of the each boot shaped structure which in turn creates resonance vibrations to massage the user's feet; (i) whereby when the user's feet are respectively positioned within the at least two boot shaped structures and the plurality of compressible and expandable air nodes are engaged with the user's feet, and thereby massage and generate the at least one massaging pattern to massage the user's feet which effectively soothes and relaxes the user.

Defined more broadly, the present invention is a foot massaging apparatus for massaging a user's feet, comprising: (a) at least two structures connected to each other by a connecting member, each structure having a bottom portion and a body attached to the bottom portion, and means for allowing the user's foot to enter or exit the body; (b) a plurality of compressible and expandable air nodes affixed to the interior of the body of the each structure; (c) means to interconnect the plurality of compressible and expandable air nodes for transferring fluid in between; (d) at least one compressor means for supplying fluid such as compressed air to the plurality of compressible and expandable air nodes of the each structure; (e) control means for connecting to the at least one compressor means to supply the compressed air to inflate the plurality of compressible and expandable air nodes of the each structure to a desired stiffness; and (f) means for cycling the inflation and deflation rates at different intervals of the plurality of compressible and expandable air nodes of the each structure to create at least one massaging pattern to massage the user's feet within the at least two structures; (g) whereby when the user's feet are respectively positioned within the at least two structures and the plurality of compressible and expandable air nodes are engaged with the user's feet, and thereby massage and generate the at least one massaging pattern to massage the user's feet which effectively soothes and relaxes the user.

Defined even more broadly, the present invention is a foot massaging apparatus for massaging a user's foot, comprising: (a) at least one structure having a bottom portion and a body attached to the bottom portion, and means for allowing the user's foot to enter or exit the body; (b) a plurality of compressible and expandable air nodes affixed to the interior of the body; (c) means to interconnect the plurality of compressible and expandable air nodes for transferring fluid in between; (d) at least one compressor means for supplying fluid such as compressed air to the plurality of compressible and expandable air nodes; (e) control means for connecting to the at least one compressor means to supply the compressed air to inflate the plurality of compressible and expandable air nodes to a desired stiffness; and (f) means for cycling the inflation and deflation rates at different intervals of the plurality of compressible and expandable air nodes to create at least one massaging pattern to massage the user's foot within the at least one structure; (g) whereby when the user's foot is positioned within the at least one boot shaped structure and the plurality of compressible and expandable air nodes are engaged with the user's foot, and thereby massage and generate the at least one massaging pattern to massage the user's foot which effectively soothes and relaxes the user.

Defined alternatively defined in detail, the present invention is a portable air foot massaging apparatus for massaging a user's feet, comprising: (a) a fluid-tight housing having a base wall and four walls integrally connected with the base wall and extending upwardly therefrom to form a foot chamber adapted to support the user's feet and containing fluid therein; (b) a lid hingably connected to an upper edge of a respective one of the four walls for covering the foot chamber; (c) a semi-rigid plate mounted within the fluid-tight housing and spaced above and parallel to the base wall and supported by a support means; (d) a plurality of spaced apart compressible and expandable air nodes affixed to the interior of the four walls and the lid and protruding inwardly therefrom; (e) means to interconnect the plurality of compressible and expandable air nodes for transferring fluid in between; (f) compressor means mounted within the fluid-tight housing for supplying fluid such as compressed air to the plurality of compressible and expandable air nodes; (g) valve means connected to the compressor means to control the compressed air to inflate the plurality of compressible and expandable air nodes to a desired stiffness; (h) a controller having means for cycling the inflation and deflation rates at different intervals of the plurality of compressible and expandable air nodes to create at least one massaging pattern to massage the user's feet within the fluid-tight housing; and (i) eccentric vibration means mounted to the underside of the semi-rigid plate for generating vibrations to and through the semi-rigid plate which in turn creates resonance vibrations to massage the user's feet; (j) whereby when the user's feet are respectively positioned within the fluid-tight housing and the plurality of compressible and expandable air nodes are engaged with the user's feet, and thereby massage and generate the at least one massaging pattern to massage the user's feet which effectively sooth and relax the user.

Defined alternatively defined broadly, the present invention is a foot massaging apparatus for massaging a user's feet, comprising: (a) a fluid-tight housing having a base and at least three walls connected with the base and extending upwardly therefrom to form a foot chamber adapted to support the user's feet and containing fluid therein; (b) a lid hingably connected to an upper edge of a respective one of the at least three walls for covering the foot chamber; (c) plate means mounted within the fluid-tight housing and spaced above the base; (d) a plurality of compressible and expandable air nodes affixed to the interior of the at least three walls and the lid and protruding inwardly therefrom; (e) means to interconnect the plurality of compressible and expandable air nodes for transferring fluid in between; (f) at least one compressor means for supplying fluid such as compressed air to the plurality of compressible and expandable air nodes; (g) means for connecting the at least one compressor means to control the compressed air to inflate the plurality of compressible and expandable air nodes to a desired stiffness; (h) means for cycling the inflation and deflation rates at different intervals of the plurality of compressible and expandable air nodes to create at least one massaging pattern to massage the user's feet within the fluid-tight housing; and (i) means for generating vibrations to and through the plate means which in turn creates resonance vibrations to massage the user's feet; (j) whereby when the user's feet are respectively positioned within the fluid-tight housing and the plurality of compressible and expandable air nodes are engaged with the user's feet, and thereby massage and generate the at least one massaging pattern to massage the user's feet which effectively soothes and relaxes the user.

Defined alternatively more broadly, the present invention is a foot massaging apparatus for massaging a user's feet, comprising: a fluid-tight housing adapted to support the user's feet and fluid therein; (a) a plurality of compressible and expandable air nodes affixed to the interior of the fluid-tight housing and protruding inwardly therefrom; (b) means to interconnect the plurality of compressible and expandable air nodes for transferring fluid in between; (c) at least one compressor means for supplying fluid such as compressed air to the plurality of compressible and expandable air nodes; (d) control means for connecting to the at least one compressor means to control the compressed air to inflate the plurality of compressible and expandable air nodes to a desired stiffness; and (e) means for cycling inflation and deflation rates at different intervals of the plurality of compressible and expandable air nodes to create at least one massaging pattern to massage the user's feet within the fluid-tight housing; (f) whereby when the user's feet are respectively positioned within the fluid-tight housing and the plurality of compressible and expandable air nodes are engaged with the user's feet, and thereby massage and generate the at least one massaging pattern to massage the user's feet which effectively soothes and relaxes the user.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

The present invention has been described in considerable detail in order to comply with the patent laws by providing full public disclosure of at least one of its forms. However, such detailed description is not intended in any way to limit the broad features or principles of the present invention, or the scope of the patent to be granted. Therefore, the invention is to be limited only by the scope of the appended claims.

What is claimed is:

1. A portable air foot massaging apparatus for massaging a user's feet, comprising:

a. a fluid-tight housing having a base wall and four walls integrally connected with the base wall and extending upwardly therefrom to form a foot chamber adapted to support the user's feet and containing fluid therein;

b. a lid hingably connected to an upper edge of a respective one of said four walls for covering said foot chamber;

c. a semi-rigid plate mounted within said fluid-tight housing and spaced above and parallel to said base wall and supported by a support means;

d. a plurality of spaced apart compressible and expandable air nodes affixed to the interior of said four walls and said lid and protruding inwardly therefrom;

e. means to interconnect said plurality of compressible and expandable air nodes for transferring fluid in between;

f. compressor means mounted within said fluid-tight housing for supplying fluid such as compressed air to said plurality of compressible and expandable air nodes;

g. valve means connected to said compressor means to control the compressed air to inflate said plurality of compressible and expandable air nodes to a desired stiffness;

h. a controller having means for cycling the inflation and deflation rates at different intervals of said plurality of compressible and expandable air nodes to create at least one massaging pattern to massage the user's feet within said fluid-tight housing; and i. eccentric vibration means mounted to the underside of said semi-rigid plate for generating vibrations to and through said semi-rigid plate which in turn creates resonance vibrations to massage the user's feet;

j. whereby when the user's feet are respectively positioned within said fluid-tight housing and said plurality of compressible and expandable air nodes are engaged with the user's feet, and thereby massage and generate said at least one massaging pattern to massage the user's feet which effectively sooth and relax the user.

2. The apparatus in accordance with claim 1, wherein said semi-rigid plate further comprises a plurality of hollow spaced apart protruding nodes.

3. The apparatus in accordance with claim 1, wherein said semi-rigid plate further comprises a plurality of solid spaced apart protruding nodes.

4. The apparatus in accordance with claim 1, wherein said support means includes a plurality of spaced apart vertical dividers.

5. The apparatus in accordance with claim 1, further comprising at least one adjustable air bladder located between the interior of said lid and said plurality of compressible and expandable air nodes for providing an adjustment to accommodate different sized feet within said fluid-tight housing.

6. The apparatus in accordance with claim 1, wherein said means to interconnect said plurality of compressible and expandable air nodes for transferring fluid in between includes a plurality of tubes interconnecting adjacent compressible and expandable air nodes.

7. A foot massaging apparatus for massaging a user's feet, comprising:

a. a fluid-tight housing having a base and at least three walls connected with the base and extending upwardly therefrom to form a foot chamber adapted to support the user's feet and containing fluid therein;

b. a lid hingably connected to an upper edge of a respective one of said at least three walls for covering said foot chamber;

c. plate means mounted within said fluid-tight housing and spaced above said base;

d. a plurality of compressible and expandable air nodes affixed to the interior of said at least three walls and said lid and protruding inwardly therefrom;

e. means to interconnect said plurality of compressible and expandable air nodes for transferring fluid in between;

f. at least one compressor means mounted within said fluid-tight housing for supplying fluid such as compressed air to said plurality of compressible and expandable air nodes;

g. means for connecting said at least one compressor means to control the compressed air to inflate said plurality of compressible and expandable air nodes to a desired stiffness;

h. means for cycling the inflation and deflation rates at different intervals of said plurality of compressible and expandable air nodes to create at least one massaging pattern to massage the user's feet within said fluid-tight housing; and i. means for generating vibrations to and through said plate means which in turn creates resonance vibrations to massage the user's feet;

j. whereby when the user's feet are respectively positioned within said fluid-tight housing and said plurality of compressible and expandable air nodes are engaged with the user's feet, and thereby massage and generate said at least one massaging pattern to massage the user's feet which effectively soothes and relaxes the user.

8. The apparatus in accordance with claim 7, wherein said plate means further comprises a plurality of hollow spaced apart protruding nodes.

9. The apparatus in accordance with claim 7, wherein said plate means further comprises a plurality of solid spaced apart protruding nodes.

10. The apparatus in accordance with claim 7, further comprising at least one adjustable air bladder located between the interior of said lid and said plurality of compressible and expandable air nodes for providing an adjustment to accommodate different sized feet within said fluid-tight housing.

11. The apparatus in accordance with claim 7, wherein said means to interconnect said plurality of compressible and expandable air nodes for transferring fluid in between includes a plurality of tubes interconnecting adjacent compressible and expandable air nodes.

12. The apparatus in accordance with claim 7, wherein said means for connecting to said at least one compressor means to control the compressed air to inflate said plurality of compressible and expandable air nodes to a desired stiffness includes a solenoid valve.

13. The apparatus in accordance with claim 7, wherein said means for cycling the inflation and deflation rates at different intervals includes a controller device.

14. The apparatus in accordance with claim 7, wherein said means for generating vibrations includes an eccentric vibration motor.

15. A foot massaging apparatus for massaging a user's feet, comprising:

a. a fluid-tight housing adapted to support the user's feet and fluid therein;

b. a lid hingably connected to an upper edge of said fluid-tight housing for covering said housing;

c. a plurality of compressible and expandable air nodes affixed to the interior of said fluid-tight housing and protruding inwardly therefrom;

d. means to interconnect said plurality of compressible and expandable air nodes for transferring fluid in between;

e. at least one compressor means mounted within said fluid-tight housing for supplying fluid such as compressed air to said plurality of compressible and expandable air nodes; and f. control means for connecting to said at least one compressor means to cycle inflation and deflation rates at different intervals when supplying fluid such as compressed air to said plurality of compressible and expandable air nodes to create a multiplicity of massaging patterns to massage the user's feet;

g. whereby when the user's feet are respectively positioned within said fluid-tight housing and said plurality of compressible and expandable air nodes are engaged with the user's feet, the plurality of compressible and expandable air nodes thereby massage and generate a multiplicity of massaging patterns to massage the user's feet which effectively soothes and relaxes the user.

16. The apparatus in accordance with claim 15, further comprising a semi-rigid plate mounted within said fluid-tight housing.

17. The apparatus in accordance with claim 16, further comprising means for generating vibrations to and through said plate which in turn creates resonance vibrations to massage the user's feet.

18. The apparatus in accordance with claim 17, wherein said means for generating vibrations includes an eccentric vibration motor.

19. The apparatus in accordance with claim 15, wherein said means to interconnect said plurality of compressible and expandable air nodes for transferring fluid in between includes a plurality of tubes interconnecting adjacent compressible and expandable air nodes.

20. The apparatus in accordance with claim 15, wherein said control means includes a solenoid valve.

* * * * *